US007330132B1

(12) United States Patent
Kauffman

(10) Patent No.: US 7,330,132 B1
(45) Date of Patent: Feb. 12, 2008

(54) ACTIVATION OF AN INDUCTANCE LOOP VEHICLE DETECTOR

(76) Inventor: Scott Kauffman, 9736 SE. Stephens St., Portland, OR (US) 97216

( * ) Notice: Subject to any disclaimer, the term of this patent is extended or adjusted under 35 U.S.C. 154(b) by 0 days.

(21) Appl. No.: 10/677,536

(22) Filed: Oct. 3, 2003

Related U.S. Application Data

(63) Continuation-in-part of application No. 09/904,419, filed on Jul. 12, 2001, now Pat. No. 7,026,955.

(51) Int. Cl.
*G08G 1/01* (2006.01)

(52) U.S. Cl. ..... 340/941; 340/933; 340/36

(58) Field of Classification Search ..... 340/901, 340/905, 933, 934, 935, 936, 941; 342/42; 248/683, 163.1; 701/117, 118; 235/384, 235/449

See application file for complete search history.

(56) References Cited

U.S. PATENT DOCUMENTS 3,588,806 A * 6/1971 Wilcox ..... 340/941
3,943,339 A 3/1976 Koerner et al.
3,949,252 A 4/1976 Riesenberg et al.
3,989,932 A 11/1976 Koerner
4,038,633 A 7/1977 King
4,430,636 A 2/1984 Bruce
4,531,560 A * 7/1985 Balanky ..... 150/166
4,568,937 A 2/1986 Clark
4,668,951 A 5/1987 Duley et al.
4,965,583 A * 10/1990 Broxmeyer ..... 342/42
5,057,831 A * 10/1991 Strang et al. ..... 340/941
5,201,111 A 4/1993 Prohaska
5,396,234 A 3/1995 Gebert et al.
5,652,577 A * 7/1997 Frasier ..... 340/933
5,659,290 A 8/1997 Haeri
5,936,551 A 8/1999 Allen et al.
6,042,080 A * 3/2000 Shepherd et al. ..... 248/683
6,345,228 B1 2/2002 Lees
6,378,772 B1 * 4/2002 Yonemura ..... 235/384
6,466,862 B1 * 10/2002 DeKock et al. ..... 701/117
6,535,143 B1 3/2003 Miyamoto et al.

* cited by examiner

*Primary Examiner*—Van T. Trieu
(74) *Attorney, Agent, or Firm*—Banner & Witcoff, Ltd.

(57) ABSTRACT

An apparatus and method for activating an inductance loop vehicle detector is disclosed, wherein a magnet is positioned within a casing and attached to a vehicle. In order to activate the inductance loop vehicle detector, the vehicle, attached magnet, and casing are moved in relation to an induction loop embedded within a roadway. A reaction between the magnet and induction loop causes the inductance loop vehicle detector to register the presence of a vehicle. The casing may be configured to form a separation distance between the magnet and the vehicle to enhance the magnetic field proximal the induction loop.

32 Claims, 5 Drawing Sheets

ACTIVATION OF AN INDUCTANCE LOOP VEHICLE DETECTOR

CROSS-REFERENCE TO RELATED APPLICATION

This application is a continuation-in-part application of U.S. patent application No. 09/904,419, which was filed in the U.S. Patent and Trademark Office on Jul. 21, 2001, naming Scott Kauffman as inventor, which application issued as U.S. Pat. No. 7,026,955 on Apr. 11, 2006 and is hereby entirely incorporated by reference.

BACKGROUND OF THE INVENTION

1. Field of the Invention

The present invention relates to the activation of an inductance loop vehicle detector that senses vehicles, such as vehicles located at an intersection for the purpose of triggering a traffic signal device. Various examples of the invention are particularly related to a magnetic device, or a method that uses a magnetic device, attached to a vehicle and which assists in activating an inductance loop vehicle detector.

2. Description of Background Art

In order to regulate vehicular traffic in an efficient manner, intersections with traffic signals often include an inductance loop vehicle detector. This type of detector senses the presence of vehicles located at an intersection. The basic configuration of such a vehicle detector includes an induction loop (e.g., a wire coil) that is located beneath a roadway. The induction loop is connected to a control box that includes one or more oscillators and an oscillation counter. The oscillator produces an oscillating signal in the induction loop and the oscillation counter stores information relating to the frequency of the oscillation in the induction loop.

When a vehicle approaches such a vehicle detector, conducting material (e.g. metal) in the vehicle decreases the inductance of the induction loop, thereby increasing the oscillation frequency of the detector. The decrease in inductance occurs because the conducting material in the vehicle acts as a shortened turn in the induction loop. To determine whether a vehicle is present at the intersection, the vehicle detector compares the current oscillation frequency with a previously measured oscillation frequency. If the current oscillation frequency is greater than the prior oscillation frequency, it determines that a vehicle is present. If, however, the current oscillation frequency is less than or equal to the prior oscillation frequency, then the detector determines that a vehicle is not present.

As previously noted, this type of vehicle detector may be deployed at a traffic intersection to alter a traffic signal controller of the presence of a vehicle. With this arrangement, a vehicle may enter an intersection, remain at an intersection, or leave an intersection between successive oscillation counts. If the oscillation counter senses an increase in the oscillation frequency, the detector generates a control signal alerting a traffic signal controller of the presence of a vehicle. Generally, the traffic signal controller will respond to the control signal after a preset delay period by changing the traffic signal configuration (e.g., from a red traffic light signal to a green traffic light signal). If the traffic signal controller has not altered the traffic signal configuration and a succeeding oscillation count remains at the higher level, the detector generates a control signal to alert the traffic signal controller of the continued presence of a vehicle. Similarly, if a succeeding oscillation count returns to a base level, the detector may generate a control signal to alert the traffic signal controller of the vehicle's departure, thereby eliminating the need for a change in the traffic signal's configuration.

In addition to vehicles that are located proximal to the inductance loop, environmental factors may affect the inductance of the loop. In multi-lane intersections, for example, vehicles stopped in one lane may alter the inductance of a loop located in a neighboring lane. Where intersections are located near train tracks, the presence of a train may also affect loop inductance. Further, fluctuations in the electrical load of the detector may alter the inductance properties of the loop. Accordingly, inductance loop vehicle detectors are often calibrated such that small changes in oscillation frequency do not generate a control signal to traffic signal controller. Instead, only changes in frequency that are above the preset level will affect the operation of the traffic signal controller.

A common, detrimental effect of the calibration is that vehicles with a relatively small quantity of conducting material, such as bicycles, motorcycles, and smaller automobiles, do not create an inductance in the loop sufficient to alter the oscillation frequency of commonly used vehicle detectors beyond their calibrated level. When such a vehicle enters an intersection with an inductance loop detector, the detector does not generate a control signal to alert the traffic signal controller of the vehicle's presence. Accordingly, there is a need in the art for an apparatus and/or method that may be used in conjunction with vehicles that have a relatively small quantity of conducting material to activate inductance loop vehicle detectors.

SUMMARY OF THE INVENTION

Advantageously, various embodiments of the present invention provide an apparatus for activating an inductance loop vehicle detector. Various examples of the apparatus includes a magnet and a mount that attaches the magnet to a vehicle. With some embodiments of the invention, the magnet may be a grade 5 ceramic magnet having a total flux of at least 20,000 maxwells, a maximum energy product of 6.5 MGOe or greater, a residual induction of at least 30,000 gauss, and a coercive force of at least 2200 oersteds. Additionally, with some embodiments, a coating may be applied to the magnet to increase its aesthetic properties and provide protection from corrosion or wear. Also, with some embodiments of the invention, the mount is used to secure the magnet to a portion of the vehicle that is in close proximity to the underlying roadway and thus to an inductance loop embedded within the roadway.

In addition to the magnet, with various embodiments of the invention the apparatus may also include a casing that extends at least partially around the magnet. The casing may be, for example, a polymer element that receives the magnet and forms a plurality of protrusions. The protrusions may be utilized, for example, to form a separation distance between the magnet and the portion of the vehicle to which the magnet is attached, thereby strengthening the impact of the magnet field on a proximal inductance loop.

Various examples of the invention may be used to retrofit existing vehicles, or they may be added during manufacture of a new vehicle. In either respect, the vehicle and attached magnet may be moved in proximity to an induction loop vehicle detector, to thereby prompt a change in, for example, an associated traffic light configuration and thus provide the driver of the vehicle with a green traffic signal light.

Various advantages and features of novelty that characterize the invention are pointed out with particularity in the claims. For a better understanding of the invention and its advantages, however, reference may be made to the attached drawings and to the accompanying descriptive matter, in which there is illustrated and described various embodiments of the invention.

DESCRIPTION OF THE DRAWINGS

The foregoing Summary of the Invention, as well as the following Detailed Description of the Drawings, be better understood when read in conjunction with the accompanying drawings.

DETAILED DESCRIPTION OF THE INVENTION

Figure 1:
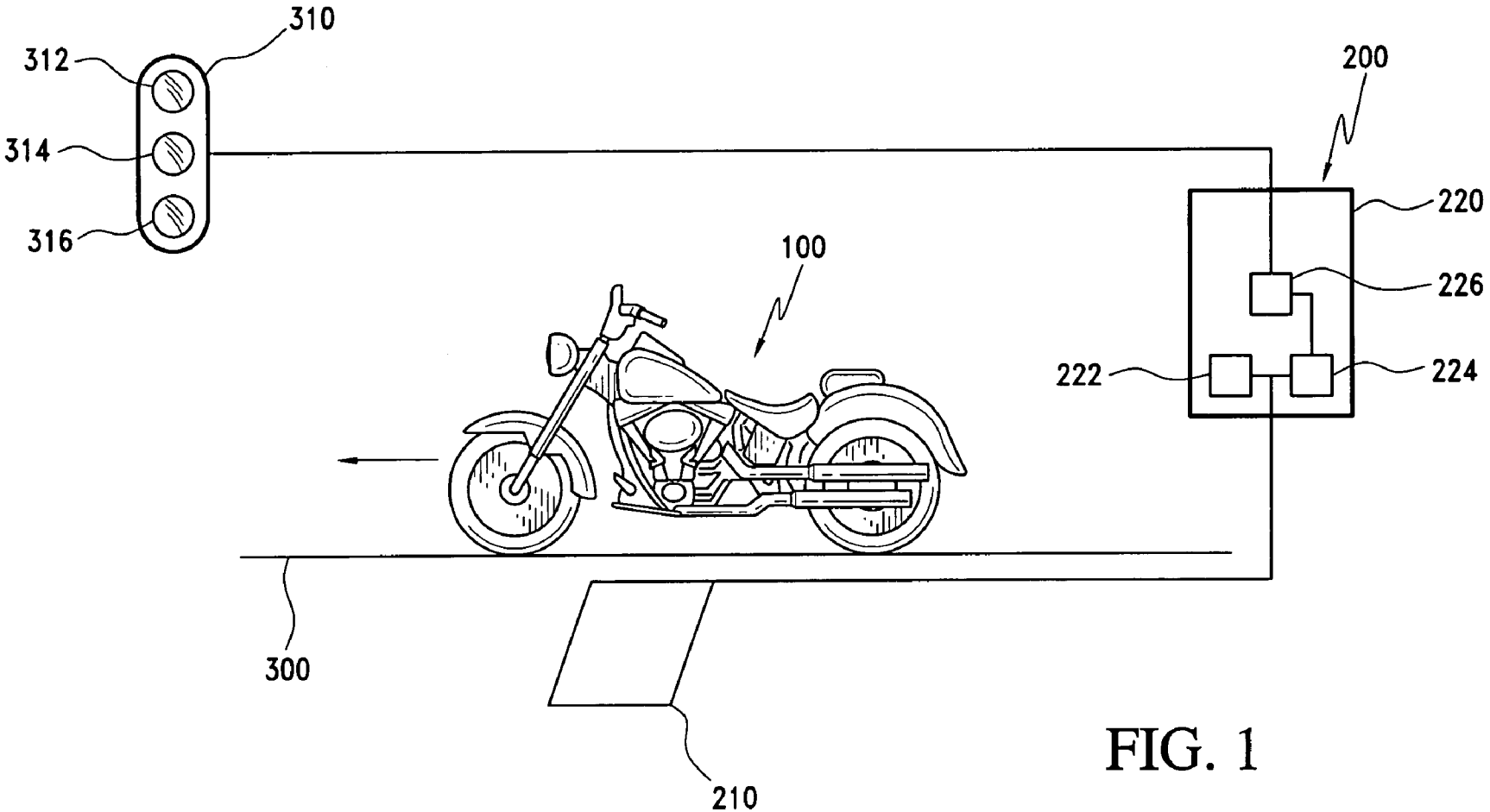
FIG. 1 is a pictorial view depicting the conventional relationship between a vehicle, an inductance loop vehicle detector, and a traffic signal.

FIG. 1 depicts a vehicle 100 passing over an inductance loop 210 that is embedded in a roadway 300. Vehicle 100 is depicted as a motorcycle, but may be any type of vehicle, including an automobile, motorized scooter, or bicycle. Vehicle detector 200 includes an inductance loop 210 and a control unit 220. Inductance loop 210 may be any type of inductance loop conventionally used for vehicle detection applications. Control unit 220 is connected to inductance loop 210 and includes one or more oscillations 222, an oscillation counter 224. The control unit 220 also includes a traffic signal controller 226, which is connected to traffic signal 310 and controls the configuration of the traffic signal's red light 312, yellow light 314, and green light 316. Of course, those of ordinary skill in the art will appreciate that other types of traffic signals may employ different light colors and configurations (e.g., changing from a solid yellow light to a blinking yellow light in the presence of a vehicle).

The purpose of vehicle detector 200 is to detect vehicles, such as vehicle 100, located on the roadway 300 proximal to inductance loop 210. If vehicle 100 is not in close proximity to inductance loop 210, oscillator 222 produces oscillations at a base frequency. The presence of vehicle 100, which is partially formed of a conducting material, near inductance loop 210 acts as a shortened turn for the loop, thereby altering the inductance of induction loop 210 and increasing the frequency of oscillations produced by oscillator 222. Oscillation counter 224 senses the increased oscillation frequency and sends a control signal to traffic signal controller 226 that indicates the presence of vehicle 100. Traffic signal controller 226 then controls the configuration of traffic signal 310 such that green light 316 is illuminated after a preset period, thereby indicating that vehicle 100 may proceed through the intersection.

In some applications, the vehicle detector 200 may be calibrated such that oscillation counter 224 does not send a control signal to traffic signal controller 226 for only relatively small changes in oscillation frequency. The purpose of the calibration is to prevent environmental effects, such as vehicles in neighboring traffic lanes or the presence of a train on a nearby track, from erroneously triggering a change in the configuration of traffic signal 310. Many vehicles, however, have a quantity of conducting material that is insufficient to alter the oscillation frequency of inductance loop 210 beyond the calibrated level, and thus may be unable to trigger the vehicle detector 200. Accordingly, these vehicles may not gain the necessary green light 316 that permits such vehicles to proceed through an intersection.

Figure 2:
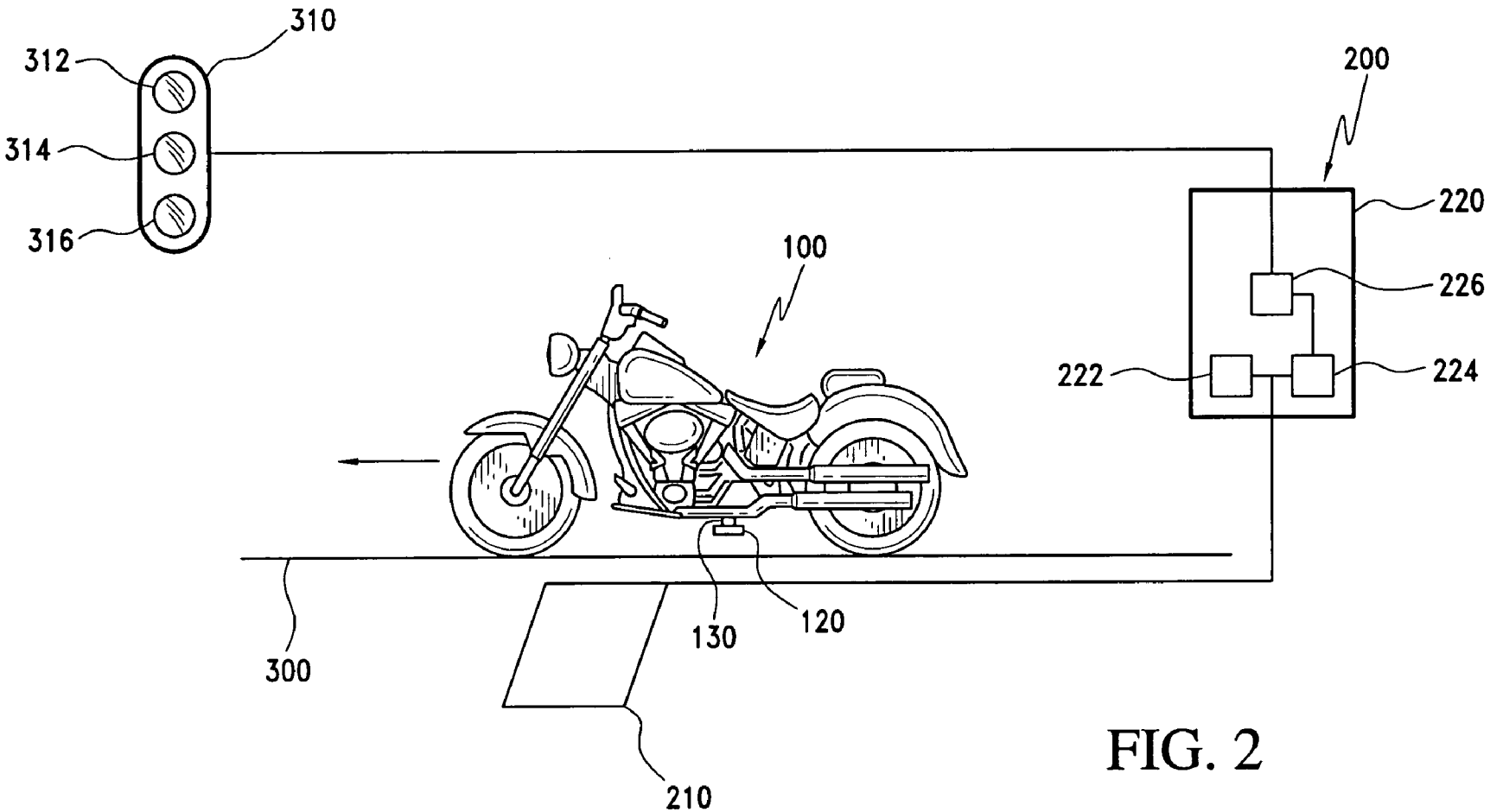
FIG. 2 is a pictorial view of the components of one preferred embodiment of the present invention.

With reference to FIG. 2, vehicle 110 is depicted as a motorcycle, but may be any type of vehicle with a relatively small quantity of conducting material, including an automobile, motorized scooter, or bicycle. Located on vehicle 110 and near roadway 300 is magnet 120. As will be discussed in detail below, mounting the magnet 120 on the vehicle 110 such that it moves with the vehicle 110 in close proximity to induction loop 210 affects the properties of vehicle detector 200 in such a manner as to cause the vehicle detector 200 to register the presence of the vehicle 110, even if the vehicle 110 would otherwise not have sufficient conductive material to trigger the detector 200. Accordingly, an altered configuration of traffic signal 310 may be achieved if vehicle 110 is in motion above inductance loop 210 for at least a short duration. Sufficient motion, for example, may occur when vehicle 110 moves over induction loop 210 before coming to a stop in compliance with an illuminated red light 312.

Figure 3:
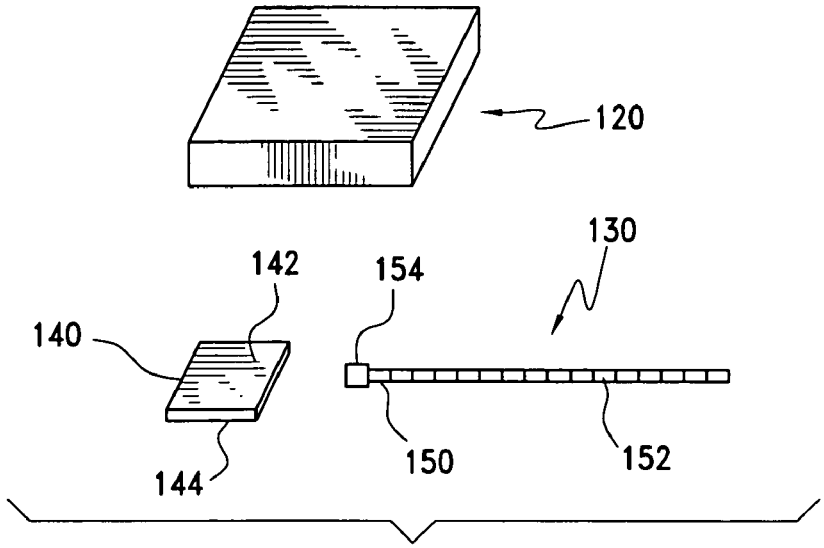
FIG. 3 is a perspective view of the components of one preferred embodiment of the present invention.

One aspect of the present invention relates to an apparatus that causes an induction loop detector 200 to register the presence of a vehicle, regardless of the amount of conductive material actually present in the vehicle. As depicted in more detail in FIG. 3, the primary components of one embodiment of the present invention include permanent magnet 120 and mount 130. As shown in this figure, mount 130 includes adhesive element 140 and tie 150.

With some embodiments of the invention, magnet 120 is a grade 5 permanent ceramic magnet having a total flux of at least 20,000 maxwells, a maximum energy product of 6.5 MGOe or greater, a residual induction of at least 3000 gauss, and a coercive force of at least 2200 oersteds. As is well known in the art, a permanent ceramic magnet is described by the general formula $MO{\bullet}6Fe_2O_3$, where M generally represents barium or strontium or a combination of barium and strontium. The magnet 120 may have a box-like shape with a length of approximately 1⅞ inches, a width of approximately ⅞ inch, and a height of approximately ⅜ inch. With these properties, magnet 120 was experimentally determined to register the presence of a vehicle approximately 90% of the intersections that use a vehicle detector like vehicle detector 200 described above. Of course, those of ordinary skill in the art will appreciate that the magnet 120 may have any size and shape suitable to its use on a desired vehicle. Moreover, as is known in art, the shape of the magnet 120 may be selected to produce improved magnetic characteristics in a desired direction (e.g., in a direction toward the bottom of the vehicle and the induction loop detector).

With some embodiments of the invention, magnet 120 may be mounted on vehicle 110 so as to be in close proximity to roadway 300, to thereby maximize the effect of the magnet 120 upon induction loop 210 located in roadway 300. The experimentally determined 90% effectiveness noted above was achieved at a distance of approximately 8 inches from the upper surface of roadway 300. For motorcycles, magnet 120 may thus be mounted on a centerstand crossbrace. With respect to bicycles, possible mounting locations include the pedal and crank.

With various embodiments of the invention, a coating may be applied to the outer surface of magnet 120 in order to, e.g., improve the overall durability of the magnet 120. For some applications of an apparatus according to the invention, the mounting placement of the magnet 120 (e.g., in close proximity to the surface of roadway 300), may expose magnet 120 to water, air borne debris, and other potential hazards. An appropriate coating may thus be used to help protect magnet 120 from corrosion and prevent breakage from objects that may contact magnet 120. A variety of coatings suitable for ceramic magnets, including conductive coatings (e.g., nickel or tin plating) and non-conductive coatings (e.g., Teflon, plastic, or rubber), may be employed. In addition to a coating, magnet 120 may be alternately or additionally be encased in a box or other protective casing.

The addition of a coating or other casing also provides a means for altering the aesthetic properties of magnet 120. The location in which magnet 120 may be mounted on vehicle 110 may be visible to those who may view vehicle 110. Accordingly, a coating color that matches the color of vehicle 110 or has the coloration of chrome may be used to permit magnet 120 to aesthetically blend into vehicle 110.

Although the magnet 120 is described above as a permanent ceramic magnet, it should be noted that any type of magnet may be employed in accordance with the invention. For example, the magnet 120 may alternately be chosen from any of the other common families of commercially available permanent magnets, including alnico (aluminum-nickel-cobalt) magnets, rare earth neodymium-iron-boron magnets, and rare earth cobalt magnets. The magnet 120 may also be an electromagnet. Advantageously, an electromagnet may provide a higher magnetic strength than may be achieved in relation to permanent magnets. An electromagnet may be connected to the vehicle's battery, if available, or it may have a separate battery. An electromagnet being used as magnet 120 may also be driven by the operation of the vehicle itself (e.g., by motion of the vehicle's crankshaft, motion of the vehicle's wheels, etc.).

Mount 130 serves the purpose of securing magnet 120 to vehicle 110. A portion of mount 130, according to one embodiment of the present invention, is adhesive element 140. More particularly, the adhesive element 140 is a foam member having adhesive surface 142 and an opposite adhesive surface 144. In order to mount magnet 120 to vehicle 110 using adhesive element 140, adhesive surface 142 is brought into contact with a surface of magnet 120, thereby adhering adhesive surface 142 to magnet 120. Adhesive surface 144 is then brought into contact with a portion of vehicle 110, thereby adhering adhesive surface 144 to vehicle 110 and effectively mounting magnet 120 on vehicle 110. Alternatively, as adhesive surface 142 is substantially the same as adhesive surface 144, adhesive surface 142 may be adhered to vehicle 110 and adhesive surface 144 may be adhered to magnet 120.

In addition to adhesive element 140, mount 130 may include tie 150. Tie 150 includes corrugated strand 152 formed from, e.g., plastic or metal, and aperture 154. In order to mount magnet 120 to vehicle 110 using tie 150, magnet 120 is positioned on vehicle 110 and corrugated strand 152 is wrapped around both magnet 120 and the portion of vehicle 110 to which magnet 120 is to be mounted. The end of corrugated strand 152 is then inserted into aperture 154 until corrugated strand 152 secures the position of magnet 120. As is well known in the art, a resistance mechanism within aperture 154 prevents corrugated strand 152 from being retracted once inserted into aperture 154. The tie 150 can be used to supplement the holding ability of the adhesive element 140.

Other mounts may be suitable in addition to adhesive element 140. For example, depending upon the shape of the magnet 120, the tie 150 alone can be used as the mount 130 to securely attach the magnet 120 to the vehicle 110. The mount 130 may also be an adhesive material, such as a silicon adhesive paste, brackets that are secured to vehicle 110 using screws or bolts, or a hook and loop fastening system that permits magnet 120 to be interchanged between multiple vehicles 110. The mount 130 may be a permanent mount, or it may removably securely affix the magnet 120 to the vehicle 110.

Figure 4:
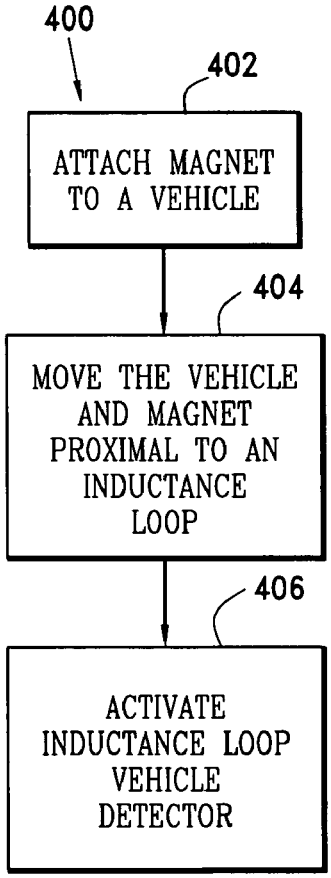
FIG. 4 is a schematic depicting a first method of the present invention.

As will be appreciated from the foregoing discussion, a method according to the invention includes the use of magnet 120 with a vehicle to trigger an induction loop detector into indicating the presence of a vehicle. One embodiment of such a method is depicted schematically in FIG. 4. As seen in this figure, the method 400 includes securely attaching the magnet 120 to the vehicle 110 in step 402. The magnet 120 may be attached to the vehicle through the magnet 130, as discussed in detail above. Alternatively, the magnet may be securely attached to the vehicle using the attractive properties of the magnet alone, depending upon the composition of the portion of the vehicle to which the magnet is mounted. For example, if the vehicle 110 is a motorcycle with an iron or steel centerstand crossbrace, and the attractive force of the magnet 120 is sufficiently strong to securely hold the magnet 120 to the motorcycle while still exerting sufficient magnetic energy in the direction of the roadway 300 (i.e., toward the induction loop detector 200), then the mount 130 may be omitted. Further, if the vehicle 110 provides a convenient location where the magnet 120 can be wedged or supported by gravity so as to be securely attached to the vehicle 110, then these attachment techniques may also be employed in place of (or in addition to) the mount 130.

Next, in step 404, the vehicle 110, with the attached magnet 120, is moved proximal to the inductance loop detector 200. Then, in step 406, the magnetic energy of the magnet 120 causes the inductance loop vehicle detector 200 to register the presence of a vehicle. In response, the inductance loop vehicle detector 200 may issue a signal to another device, e.g., a control signal to traffic signal 310, to report the presence of a vehicle.

Figure 5:
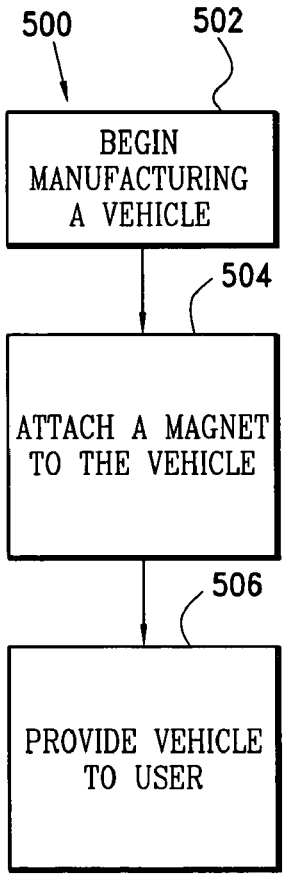
FIG. 5 is a schematic depicting a second method of the present invention.

With reference to FIG. 5, this figure schematically illustrates another method according to the invention, for manufacturing a vehicle 110. The method 500 includes the step 502 of beginning the manufacture of the vehicle 110. The method 500 also includes the step 504 of attaching the magnet 120 to the vehicle, so that the magnet 120 will activate an inductance loop detector. As previously noted, the magnet 120 can be attached to the vehicle 110 in a position that will be close to roadway 300 when the vehicle is in use. As also previously noted, the magnet 120 can be attached to the vehicle 110 using mount 130, the magnetic attractive force of the magnet 120 itself, by gravity or any other suitable force. In addition, the mount 130 can be formed integrally with the vehicle 110. For example, the vehicle 110 may be formed with a bracket or recess for holding the magnet 120. It should be noted that the manufacturer may attach magnet 120 to the vehicle at any desirable stage during manufacture of the vehicle 110. Next, in step 506, the vehicle 110 is provided to a user for use.

Figure 6:
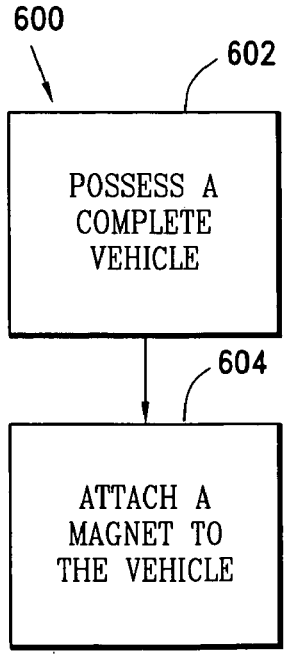
FIG. 6 is a schematic depicting a third method of the present invention.
Figure 7:
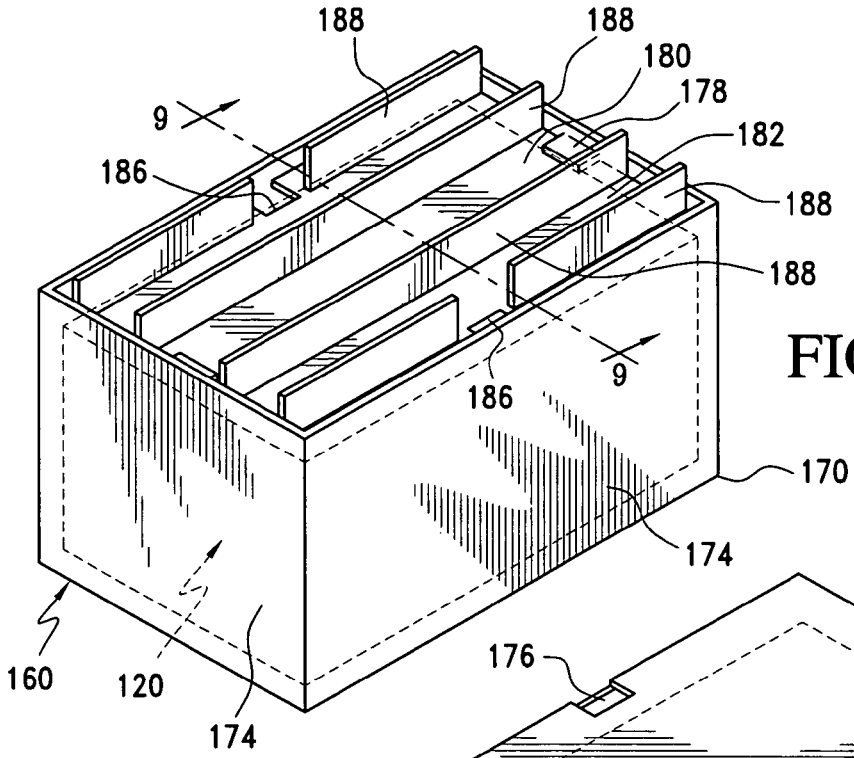
FIG. 7 is a first perspective view of a magnet located within a casing.
Figure 8:
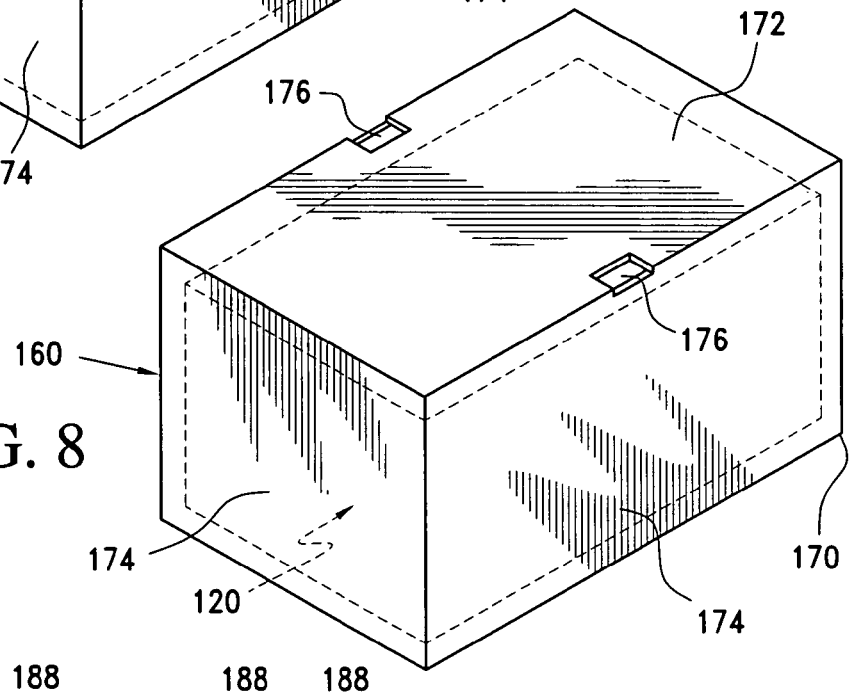
FIG. 8 is a second perspective view of the magnet located within the casing.
Figure 9:
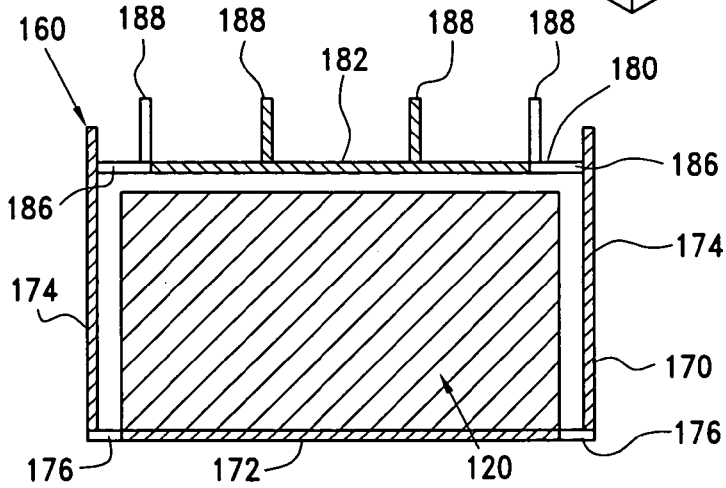
FIG. 9 is a cross-sectional view of the magnet and the casing, as defined by section lines 9-9 in FIGS. 7 and 8.
Figure 10:
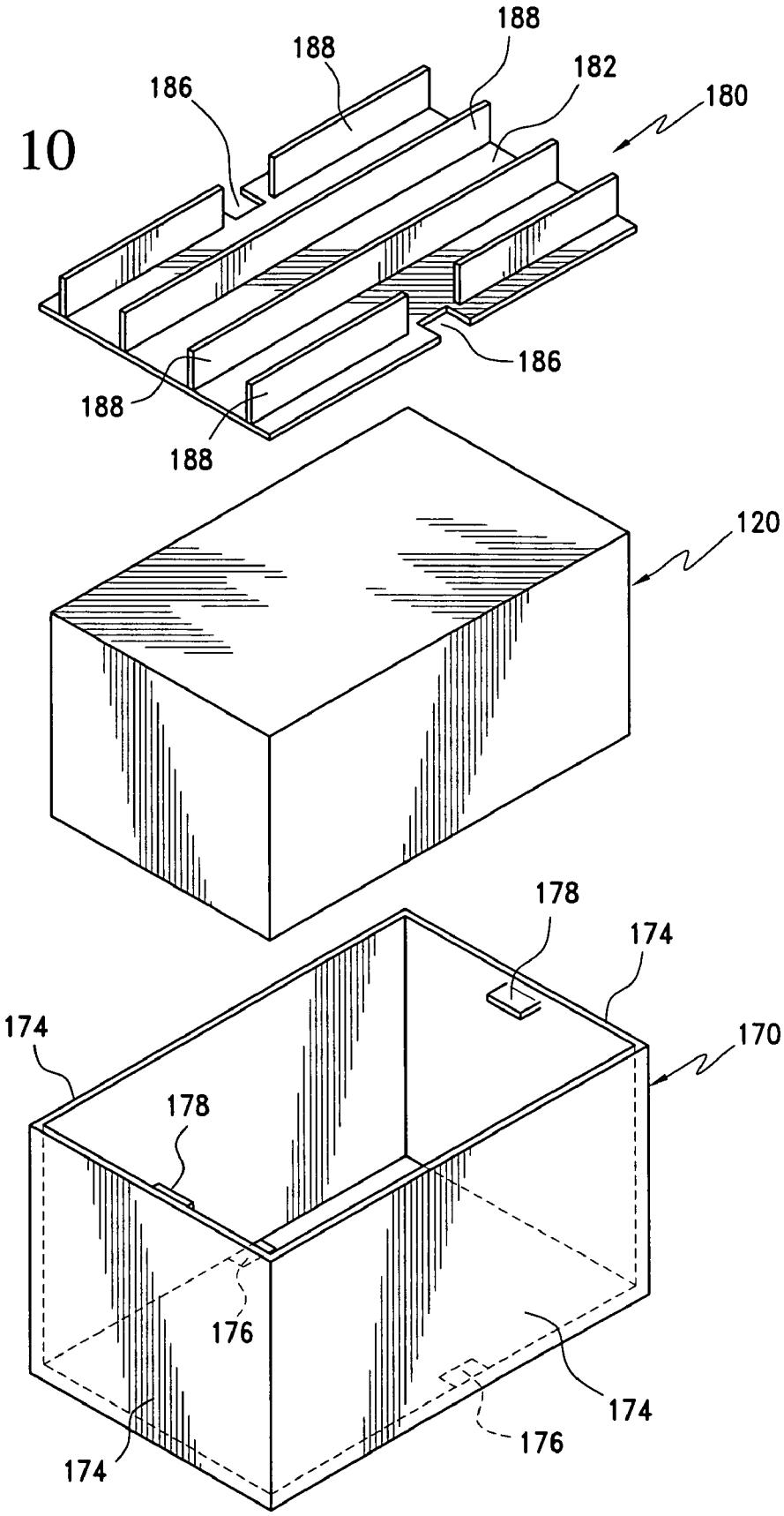
FIG. 10 is an exploded perspective view of the magnet and the casing

FIG. 6 depicts still another method 600 according to the invention, for retrofitting a vehicle 110 to include the magnet 120. The method 600 includes possessing or obtaining the vehicle 110 in step 602, and then attaching the magnet 120 to the vehicle 110 for the purposes of activating an inductance loop vehicle detector in step 604. As previously noted, the mount 130 may be used to attach the magnet 120 to the vehicle 110. Alternately, a sufficiently strong attachment may be made through the attractive force of the magnetic alone. As was previously described, the magnet 120 can be attached to the vehicle 110 using mount 130, the magnetic attractive force of the magnet 120 itself, by gravity or any other suitable force. Thus, according to the method 600 of the invention, a vehicle 110 that would not otherwise trigger a vehicle detector 200 may be retrofitted so as to activate such a system.

As discussed above, a coating may be applied to the outer surface of magnet 120 in order to improve the overall durability of the magnet 120, and a variety of coatings suitable for ceramic magnets, including conductive coatings and non-conductive coatings, may be employed. In addition to a coating, the magnet 120 may be encased in a box or other protective casing. One example of such a casing 160 is depicted in FIGS. 7-10. This casing 160 includes a first element 170 and a second element 180, which join together to cooperatively extend around the magnet 120. The first element 170 forms a first end wall 172 (see FIG. 8) and sidewalls 174 of the casing 160, thereby defining a cavity of the proper shape and size to receive the magnet 120. The second element 180 forms a second end wall 182 of the casing 160 that is positioned opposite the first surface 172 to effectively close the cavity and secure the magnet 120 within the casing 160.

The first element 170 defines a pair of apertures 176 in the first end wall 172 such that each aperture 176 is adjacent to a sidewall 174. Similarly, the second element 180 defines a pair of indentations 186 in the end wall 182 that are opposite the apertures 176 and adjacent to the sidewalls 174. When the end wall 182 is placed over or within the sidewalls 174 so as to enclose the magnet 120, the indentations 186 form apertures between the edges of the end wall 182 and the side walls 174. Thus, the apertures 176 and the indentations 186 form a pair of passages that extend through the casing 160 and may be utilized to assist with mounting the magnet 120 to the vehicle 110. For example, a cord, string, strap or other binder may be placed through the passages and around a portion of the vehicle 110 to effectively mount the magnet 120 to the vehicle 110. In addition, the tie 150 may be employed such that the corrugated strand 152 extends through the passages formed in casing 160 and around a portion of the vehicle 110. It should be noted, however, that a plurality of other features may alternately or additionally be formed in the casing 160 to assist with mounting of the magnet 120 to the vehicle 110. In some embodiments, therefore, the casing 160 may include a mounting part that mates with a corresponding mounting part that is secured to the vehicle 110 during manufacture.

The exterior surface of the first element 170 may have a smooth configuration. In contrast the exterior surface of the second element 180 may have a plurality of protrusions, such as protrusions 188 that are linear and oriented parallel to each other. The protrusions 188 provide at least two features. First, the protrusions 188 engage rounded or otherwise non-planar surfaces in a more secure manner than would, for example, a flat surface if the protrusions 188 were not present. Second, the protrusions 188 maintain a minimum separation distance between the magnet 120 and the portion of the vehicle 110 to which the magnet 120 is mounted. The advantages offered by this minimum separation distance are discussed in greater detail below.

In the absence of conductive objects or materials, a magnetic field produced by a magnet will generally be uniform, depending upon the shape of the magnet. When conductive objects or materials are located proximal to a magnet, however, these conductive objects or materials will have an effect upon the uniformity of the magnetic field. More particularly, the strength of the magnetic field will be greater on the side of the magnet that is proximal to the conductive object or material, and the strength of the magnetic field will be weaker on the side of the magnet that is opposite the conductive object or material.

With regard to various embodiments of the present invention, this phenomenon may have an effect upon the magnetic field of the magnet 120, which is mounted on a portion of the vehicle 110 that is often conductive (or close to a conductive portion of the vehicle 110). Whereas the portion of the vehicle 110 to which the magnet 120 is mounted is positioned on one side of the magnet 120, the induction loop 210 will typically be located on the opposite side of the magnet 120. Thus, the strength of the magnetic field produced by the magnet 120 may be greater on the side of the magnet 120 that is opposite the induction loop 210, and the strength of the magnetic field produced by magnet 120 may be correspondingly diminished on the side of the magnet 120 that is used to affect the inductance of inductance loop 210.

This effect of a conductive object or material on the magnetic field of a magnetic is at least partially dependent upon the distance between the magnet and the conductive object or material. As a magnet is moved away from a conductive object or material, the strength of the magnetic field thus tends to become more uniform on opposite sides of the magnet. Accordingly, when the magnet 120 is distanced from the portion of the vehicle to which the magnet 120 is mounted, the strength of its magnetic field facing the inductance loop 210 typically is greater than if the magnet 120 is closer to or contacts the portion of the vehicle to which the magnet 120 is mounted. That is, the separation distance between the magnet 120 and the portion of the vehicle 110 to which the magnet 120 is mounted, which is formed by the protrusions 188, serves to strengthen the portion of the magnetic field directed toward the inductance loop 210, thereby increasing the effectiveness of the magnet 120.

In manufacturing the casing 160, the first element 170 and the second element 180 may be formed separately and subsequently secured together once the magnet 120 is positioned within the cavity formed by the first element 170. In order to secure the first element 170 and the second element 180 together, one or more protrusions 178 may extend outward from a surface of the first element 170. Once the magnet 120 is positioned within the cavity, the second element 180 may be snapped into place such that the protrusions 178 restrict outward movement of the second element 180. It should be appreciated, however, that a variety of securing techniques may be utilized to securely attach first element 170 to second element 180, including adhesives and thermal bonding, for example.

Any suitable material can be used to form one or more portions of the casing 160, including, for example, a variety of polymer and non-polymer materials. With regard to polymer materials, the casing 160 may be formed from nylon, polyurethane, or polypropylene, for example. The casing 160 may also be formed from metal materials, including aluminum, bronze, and titanium. A conducting metal may also be used for the casing 160, although the benefit discussed above with regard to the separation distance may be lessened.

The general configuration of casing 160 discussed above is intended to be one example of a plurality of casing configurations that fall within the scope of the present invention. As an alternative, therefore, the magnet 120 may be co-molded with a polymer casing such that the polymer material is formed from a single, integral element that extends entirely around the magnet 120. Alternately or additionally, the casing 160 may also extend only partially around the magnet 120 such that a portion of the magnet 120 remains exposed. Furthermore, the dimensions, number, shape and direction of the protrusions 188 may be varied as desired to, for example, increase the separation distance between the magnet 120 and the portion of the vehicle 110 to which the magnet 120 is mounted.

The protrusions 188 are one example of a structure that may be utilized to form the separation distance between the magnet and the portion of the vehicle 110 to which the magnet 120 is mounted. It should be appreciated, however, that still other embodiments of the invention may employ alternate structures to maintain the noted separation distance. In some embodiments of the present invention, for example, the thickness of the material forming the casing 160 may be increased to form the separation distance. In addition, mounting parts on both the casing 160 and the vehicle 110 may be utilized to form the separation distance.

The present invention has been described above by way of specific exemplary embodiments, and the many features and advantages of the present invention are apparent from the written description. Thus, it is intended that the appended claims cover all such features and advantages of the invention. Further, since numerous modifications and changes will readily occur to those skilled in the art, the specification is not intended to limit the invention to the exact construction and operation as illustrated and described. For example, while magnet 120 has been described above as an individual magnet, those of ordinary skill in the art will appreciate that the magnet 120 may be embodied by a plurality of magnets operating working together. Also, the invention may include any one or more elements from the apparatus and methods described herein in any combination or subcombination. Accordingly, there are any number of alternative combinations for defining the invention, which incorporate one or more elements from the specification (including the drawings, claims, and summary of the invention) in any combinations or subcombinations. Hence, all suitable modifications and equivalents may be considered as falling within the scope of the appended claims.

What is claimed is:

1. An apparatus for activating an inductance loop vehicle detector, comprising:

a magnet;

a casing extending around at least a portion of the magnet; and a mount for mounting the magnet and the casing to a vehicle, wherein the casing includes protrusions that provide a separation distance between the magnet and the vehicle.

2. The apparatus of claim 1, wherein the protrusions have a linear configuration.

3. The apparatus of claim 2, wherein at least two of the protrusions are oriented parallel to each other.

4. The apparatus of claim 1, wherein the casing includes at least a first element and a second element that cooperate to form an enclosure for receiving the magnet.

5. The apparatus of claim 4, wherein the casing defines passages therethrough for receiving the mount.

6. The apparatus of claim 5, wherein the passages are formed by an aperture in at least one of the first element and the second element.

7. The apparatus of claim 1, wherein the magnet is a permanent magnet.

8. The apparatus of claim 7, wherein the magnet is a grade 5 ceramic magnet.

9. A method for activating an inductance loop vehicle detector, comprising:

attaching a magnet positioned within a casing to a vehicle, the casing including one or more protrusions;

moving the vehicle with the magnet within the casing proximal to an inductance loop of the inductance loop vehicle detector; and spacing the magnet from the vehicle with the casing including mounting the magnet within the casing on the vehicle such that a separation distance between the magnet and the vehicle is formed by the one or more protrusions.

10. The method of claim 9, wherein the protrusions have a linear configuration.

11. The method of claim 10, wherein at least two of the protrusions are oriented parallel to each other.

12. The method of claim 9, further including enclosing the magnet within the casing.

13. The method of claim 12, wherein the casing includes a first element and a separate second element that form an enclosure for receiving the magnet.

14. The method of claim 9, wherein the step of attaching includes extending a mount through passages defined in the casing.

15. The method of claim 9, wherein the magnet is a permanent magnet.

16. The method of claim 15, wherein the magnetic is a grade 5 ceramic magnet.

17. A method for manufacturing a vehicle, comprising:

manufacturing a vehicle;

attaching a magnet positioned within a casing to the vehicle for purposes of activating proximal inductance loop detectors, the casing including one or more protrusions; and spacing the magnet from the vehicle with the casing including mounting the magnet within the casing on the vehicle such that a separation distance between the magnet and the vehicle is formed by the one or more protrusions.

18. The method of claim 17, wherein the protrusions have a linear configuration.

19. The method of claim 18, wherein at least two of the protrusions are oriented parallel to each other.

20. The method of claim 17, further including enclosing the magnet within the casing.

21. The method of claim 20, wherein the casing includes a first element and a separate second element that form an enclosure for receiving the magnet.

22. The method of claim 17, wherein the step of attaching includes extending a mount through passages defined in the casing.

23. The method of claim 17, wherein the magnet is a permanent magnet.

24. The method of claim 23, wherein the magnet is a grade 5 ceramic magnet.

25. A method of retrofitting a vehicle, comprising:

attaching a magnet positioned within a casing to a vehicle for purposes of activating inductance loop detectors proximal to the vehicle, including one or more protrusions; and spacing the magnet from the vehicle with the casing including mounting the magnet within the casing on the vehicle such that a separation distance between the magnet and the vehicle is formed by the one or more protrusions.

26. The method of claim 25, wherein the protrusions have a linear configuration.

27. The method of claim 26, wherein at least two of the protrusions are oriented parallel to each other.

28. The method of claim 25, further including enclosing the magnet within the casing.

29. The method of claim 28, wherein the casing includes a first element and a separate second element that form an enclosure for receiving the magnet.

30. The method of claim 25, wherein the step of attaching includes extending a mount through passages defined in the casing.

31. The method of claim 25, wherein the magnet is a permanent magnet.

32. The method of claim 31, wherein the magnet is a grade 5 ceramic magnet.

* * * * *